United States Patent [19]

Nelson

[11] 3,941,386

[45] Mar. 2, 1976

[54] BASKETBALL BOARD GAME APPARATUS

[76] Inventor: John H. Nelson, P.O. Box 800, Santa Cruz, Calif. 95061

[22] Filed: Sept. 19, 1974

[21] Appl. No.: 507,475

[52] U.S. Cl. ..... 273/131 C; 273/85 R; 273/134 CA

[51] Int. Cl.[2] ..... A63F 3/00

[58] Field of Search ..... 273/85, 131, 134

[56] References Cited

UNITED STATES PATENTS 1,661,216 3/1928 Destefano ..... 273/134 CA 3,545,763 12/1970 Seitz ..... 273/134 CA

*Primary Examiner*—Delbert B. Lowe

*Attorney, Agent, or Firm*—John Walker

[57] ABSTRACT

A board game in which a playing piece, representing the ball, is moved from zone to zone in an attempt to score points as in the actual game of basketball. A dial control is provided for each player which may or may not stop play upon the advancement of the ball from one zone to another, the next step in the resumption of play being decided by the rolling of dice.

2 Claims, 12 Drawing Figures

BASKETBALL BOARD GAME APPARATUS

BRIEF SUMMARY OF THE INVENTION

This invention, which I have named "Zone Basketball", relates to games, and more particularly to the type of game which features the moving of a playing piece, or marker, upon a board, the free movements of the marker being initially established by the setting on a control dial. Further play is decided by the rolling of dice upon the interruption of the free movement. There are many games in which the movements of markets are controlled by the folling of dice, but in the present invention a dual control system has been adopted whereby the playing piece may be directed into any of a number of different situations during the course of a game.

The principal object of the invention is to provide a game board and accessories, as will be described herein, which, while affording a means of recreation, will introduce an element of risk, varying in each particular situation, based on the law of probability.

A further object of the invention is to provide a game in which a player, aware of the risks involved, is free to decide on one of a number of possible moves to make, in his attempt to score points, as he moves from zone to zone.

These and other objects of the invention will become apparent during the course of the following description and appended claims, taken in connection with the accompanying drawings forming a part hereof.

Figure 1:
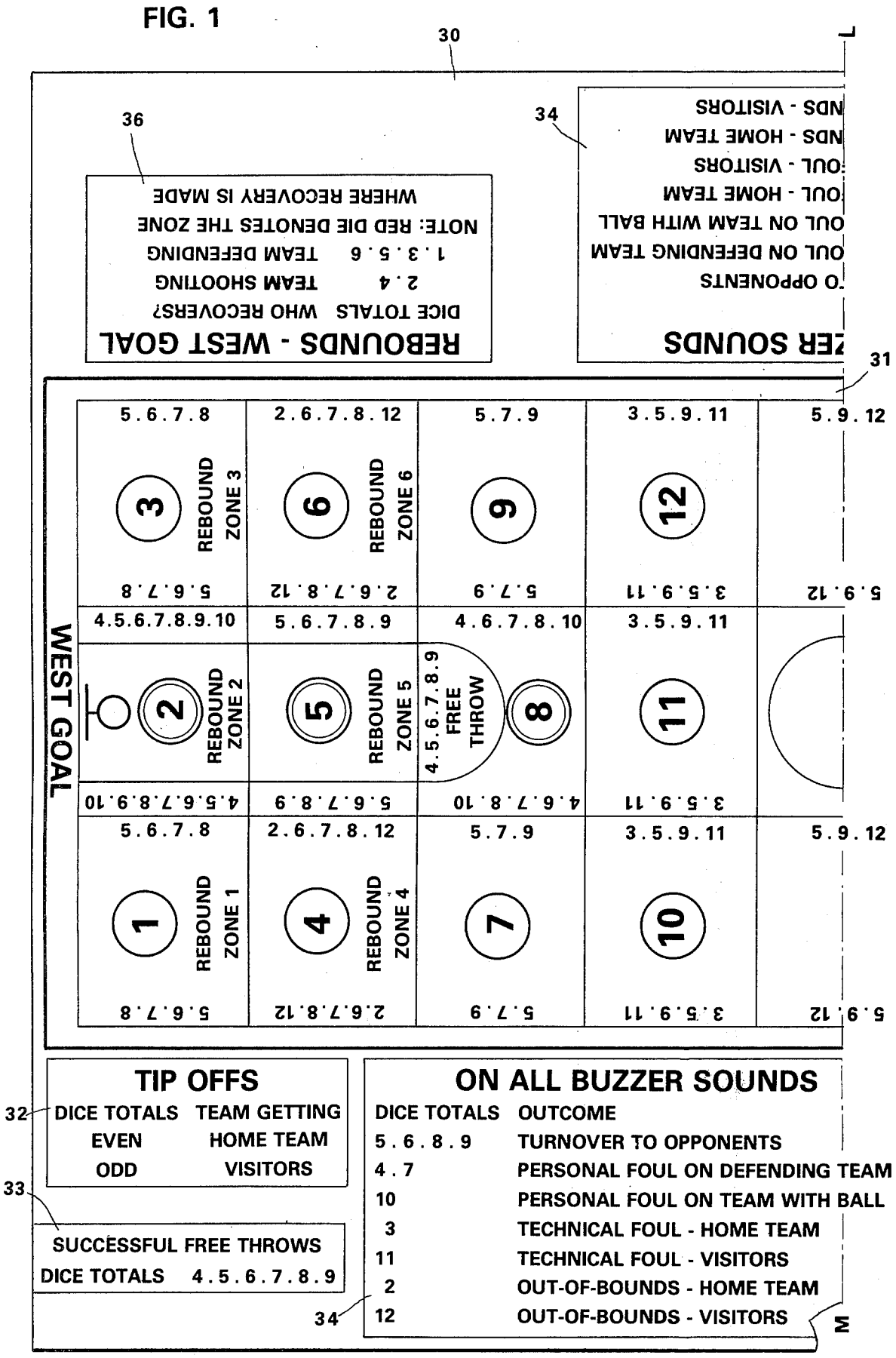
FIG. 1 is a plan view of the "West Goal" half of the game board.
Figure 2:
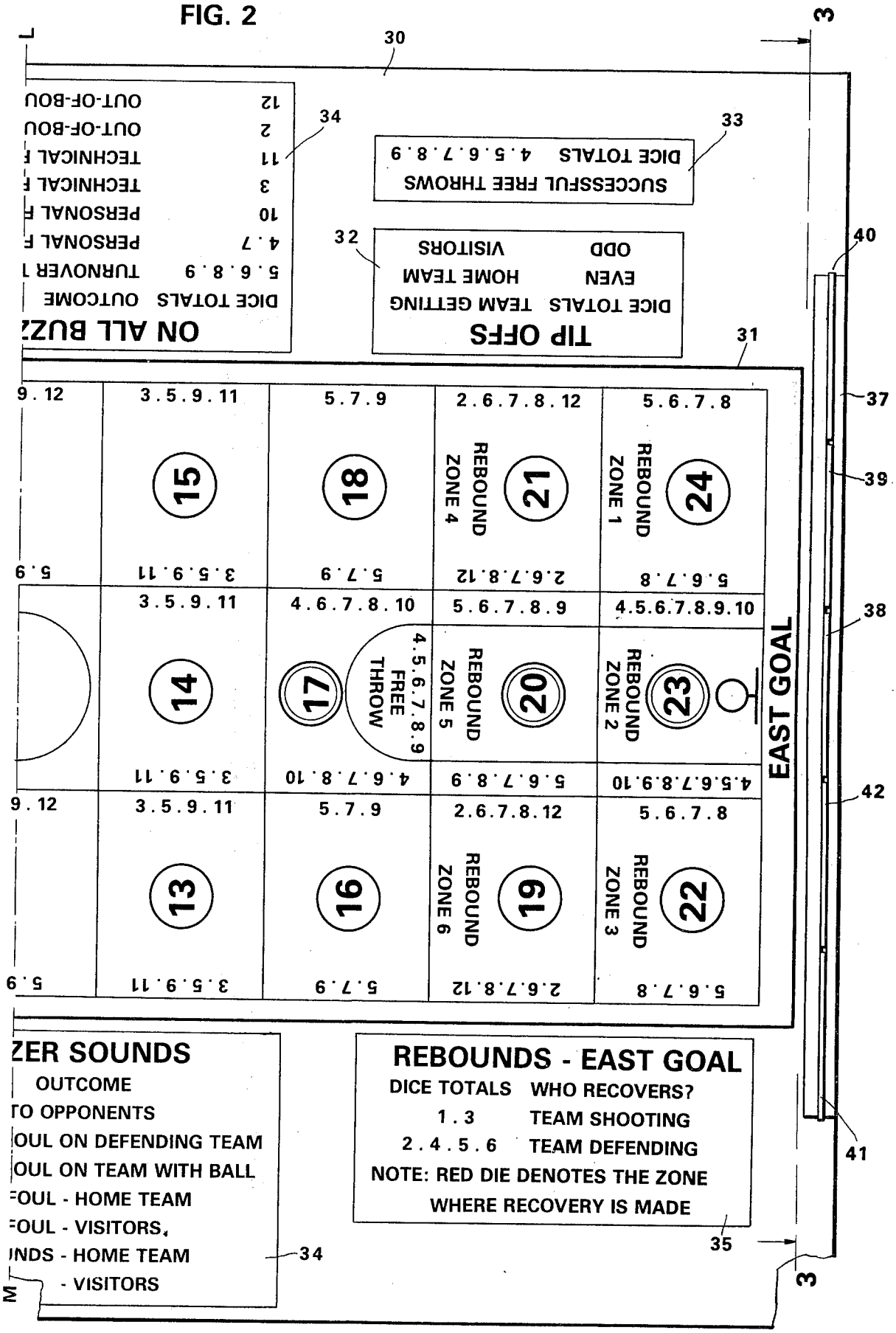
FIG. 2 is a plan view of the "East Goal" half of the game board.

Referring to the drawing in detail, a playing board 30 is illustrated, one half on FIG. 1, and the other half on FIG. 2. A match line M–L appears on each view. A playing court or area 31 has been laid out on the board and is divided into a plurality of longitudinally and transversely aligned zones as indicated. In the presently disclosed embodiment there are three longitudinal rows of nine zones each; however, this arrangement is not to be considered restrictive in either number or pattern. The center row of the nine transverse rows does not have the individual zones numbered. The remaining 24 zones are numbered consecutively as indicated by the encircled numerals appearing on the drawings.

All zones, with the exception of the central zone, have a series of probability numbers indicated thereon, as, for example, zone 12 carries the numbers 3. 5. 9. 11.

The purpose of these numbers will be explained further herein. These probability numbers are arranged as shown, in order that they can be easily read from either side of the board. It should be noted that some of the zones have more probability numbers than others. Zones 2, 5 and 8, and 17, 20 and 23 are considered as high risk zones, and have been so identfied by the double encirclement. In the production of the commercial model, other means of distinguishing these zones may be selected. Also, the probability numbers themselves could be replaced by other suitable symbols. It should be further called to attention that there is an added significance in the arrangement and frequency of occurrence of certain of the probability numbers which is definitely related to a similar arrangement of the numbers on the zone control indicators.

Appearing on the board 30, outside of the playing court, are tables 32 to 36 inclusive, each of which has been suitably captioned. These tables are so placed in order that the information they contain is immediately available to the participants during play, and their purpose will become apparent upon reference to the section headed "RULES OF THE GAME".

Figure 3:
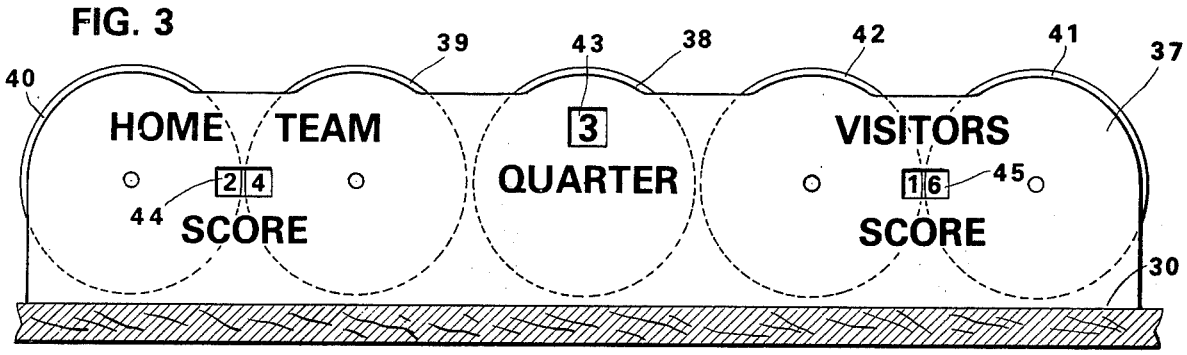
FIG. 3 is a transverse cross-section taken on line 3 — 3 of FIG. 2.
Figure 5:
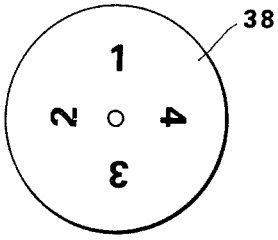
FIG. 5 is an elevation of a dial which is set to indicate the progress of a game by quarters.

Located at the east end of the playing board 30 is a score board 37. This board 37 is illustrated in elevation by FIG. 3. Mounted thereon, in any suitable manner, are a series of rotatable dials, as follows: A central dial 38, which indicates the progress of the game by quarters, unit and tens score indcators 39 and 40, respectively, for the home team, and unit and tens indicators 41 and 42, respectively, for the visiting team. The only difference between the pairs of score indicators is the fact that rotation of the dials for score advancement is always toward the respective adjacent end of the score board, dials 41 and 42 being rotated clockwise, and dials 39 and 40 being rotated counterclockwise. Details of the dials are illustrated by FIGS. 5 to 9 inclusive. Apertures 43, 44 and 45 are provided in the board 37 through which the numerals can be seen. While the score board is an essential part of the combination of the complete game, its location is not restricted by the disclosure of the present embodiment. It could be entirely separate from the playing board, and still serve the purpose for which it is intended.

Figure 10:
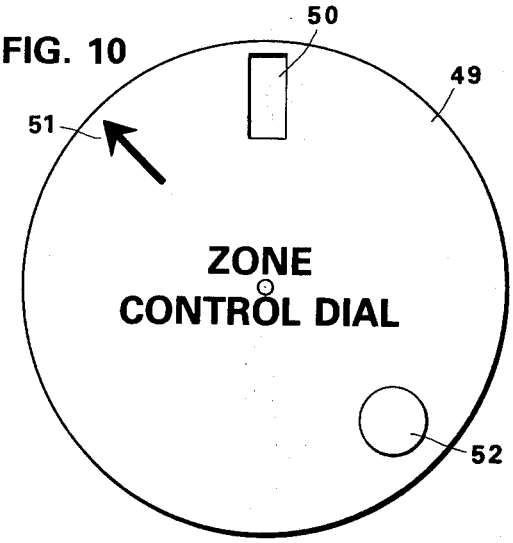
FIG. 10 is the rotary part of a zone control indicator.
Figure 7:
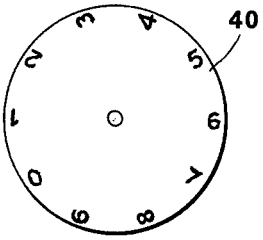
FIG. 7 is a tens score indicator for the home team.
Figure 6:
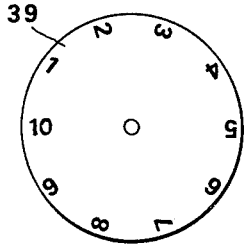
FIG. 6 is a unit score indicator for the home team.
Figure 8:
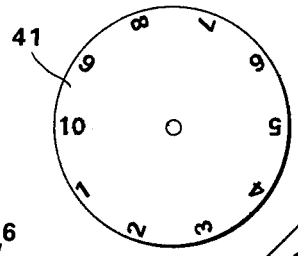
FIG. 8 is a unit score indicator for the visiting team.
Figure 9:
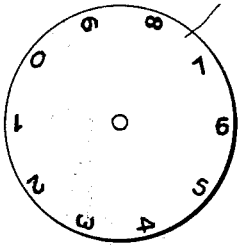
FIG. 9 is a tens score indicator for the visiting team.
Figure 11:
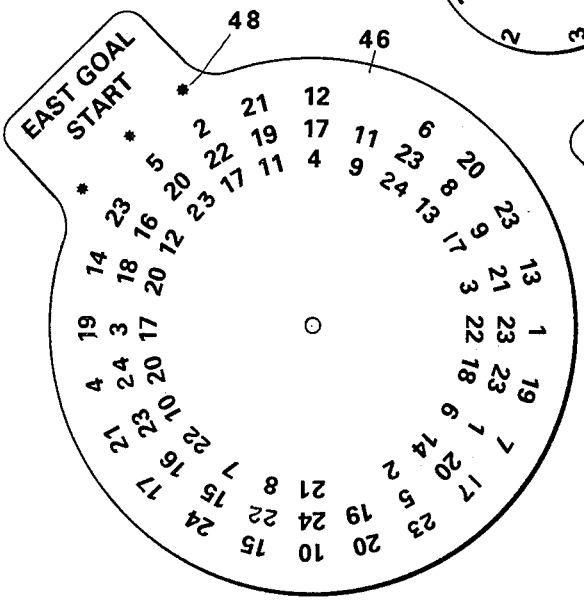
FIG. 11 is the base part of the zone control indicator for the east goal.
Figure 12:
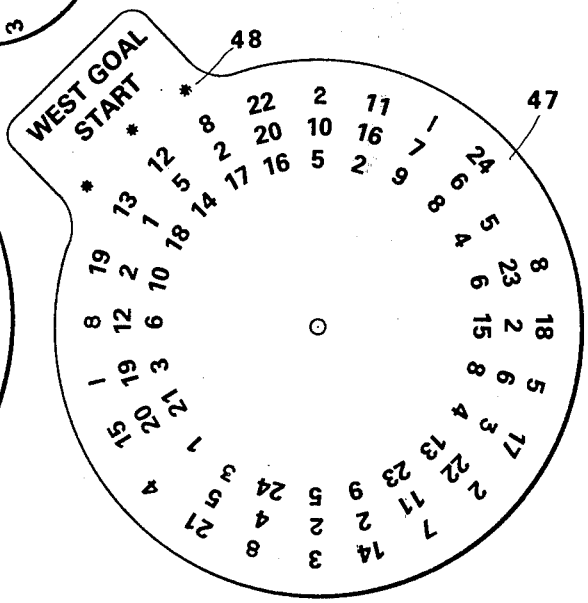
FIG. 12 is the base part of the zone control indicator for the west goal.

Illustrated by FIGS. 10, 11 and 12 are details of the zone control indicators. Each indicator consists of a base member 46 or 47, having a rotatable disc 49 mounted thereon in the usual manner with such devices. This disc 49 is provided with an aperture 50 and also has an arrow 51 imprinted thereon. When the arrow is brought into register with one of the asterisks 48, on the base, the group of three numbers appearing through the aperture will be the zone controlling numbers for the start of that particular period of play. Although the numbers differ in arrangement between the base 46 and the base 47, the frequency of occurrence of individual numbers is similar. This frequency of individual numbers is of significance relative to the aforesaid arrangement of numbers in the high risk zones. In the disclosed embodiment, the numbers 2 and 23 appear most often, followed by the numbers 5 and 20, and then the numbers 8 and 17. These numbers, which constitute the high risk probability, will be printed in red. All others will be printed in black or some other distinguishing color.

The aforesaid risk is explained by the following typical example: East has the ball and moves into zone 2, the chances of scoring are then much greater than from any other position. This is obvious from the numbers 4, 5, 6, 7, 8, 9 and 10 listed in this zone, as compared with zone 9, for example from which a successful shot can only be made by rolling a 5, a 7, or a 9. The attendant risk of play being stopped, however, from the former position, is four times as great, the number 2 appearing eight times on West's control dial, while the number 9 appears only twice.

The difference in the said arrangement of numbers, together with the fact that each of the zone control indicators has three starting points, virtually precludes the possibility of memorization of the numerals. A tab or button 52 is attached to the disc 49 to enable the manipulation of said disc.

Figure 4:
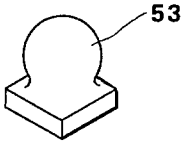
FIG. 4 is a perspective view of a typical playing piece.

A form of playing piece 53, presently contemplated, is illustrated on FIG. 4. This, of course, could be replaced by any suitable small object.

Object of the game.

The object of the game is to advance the ball through the zones on the playing court or area in such a manner that the probability of scoring, each time a shot is made, is optimum. To optimize the probability, a player must risk taking the ball into the zones nearest the basket, knowing that there is an increased possibility that the opponent may have one or more of those zones controlled.

A typical example of moves toward an opponent's goal is as follows: East goal is on the defensive and its zone control dial is set at the center point. This setting definitely establishes free movement by West, of the ball forward, from tier to tier into any zone except 20 and 23. Interruption of the free movement would occur if either of zones 20 or 23 were entered. Play would then be stopped by the sounding of a buzzer or other signal by the defensive team. Further play would then be determined by the rolling of the dice, and reference to the table ON ALL BUZZER SOUNDS.

DESCRIPTION OF PLAY

The game of zone basketball is based on the law of probability. The nearer to a basket that the ball is moved, the greater is the probability of a successful shot. Such moves, however, increase the risk of play being stopped. Players must decide how much risk to take as they approach closer to the scoring area. As stated above, play is stopped upon the movement of the playing piece into a zone, the identification number of which coincides with one of the numbers in the set position of the zone control indicator of an opponent. Play is resumed by the rolling of a pair of dice, one of which will be colored red, and by reference to tables imprinted on the board.

Step by step rules.

1. A coin is tossed or dice are rolled to determine "Home Team" and choice of goal to defend.

2. Each player sets his zone control dial at one of the three start points.

3. A method of keeping time for the quarters is decided upon, and if a watch or timer is selected, a setting is made for a period of time which conforms to the official current rules of basketball or any agreed upon length of time.

4. The ball is tipped off at center court by a roll of the dice by the "Home Team". Data on the "Tipoff Chart" determines which team gets the ball.

5. The team getting the tipoff, which is now the offensive team, takes the ball down the court, moving from zone to zone, selecting only one zone in each transverse row or tier. As each zone is entered, the number is called so that the defensive team can check it against its zone control indicator.

6. If the offensive team arrives safely at a zone from which it wishes to attempt a basket, the player calls "Shoot". The dice are then rolled by the offensive team to try to match one of the probability numbers in the particular zone. If the number is matched, two points are registered on the score board. Play continues by turning the ball over to the other team. It is then brought back into play from any point behind the basket.

7. If the offensive team fails to score, a rebound situation results and recovery of the rebound is determined by referring to the "Rebounds Chart".

8. If, while taking the ball down the court, the offensive team enters any zone controlled by the defending team, the defending team calls out "Buzz", or gives some other indication that the referee has ruled the ball dead. To determine why play is stopped, reference is made to the chart headed "On all buzzer sounds". The offensive team rolls the dice to determine the outcome.

9. Rebound situations are controlled as indicated on the tables imprinted on the playing board. The white die determines which team recovers the ball, and the red die denotes the zone where the recovery is made.

10. Play continues back and forth until the end of the quarter.

Both the white die and the red die are read to determine all dice totals. After baskets are made, the ball is put into play from any point behind the opponent's goal. From that point, one zone in each tier must be entered in moving the ball towards the opposite goal. On out of bounds calls, the ball is put in play opposite the tier where it went out. Any zone in that tier may be entered in returning the ball to the court. Long, half court shots, usually tried in the last seconds of play, are permissible only from zones in the opponent's half of the court. These zones, namely 2, 5 and 8, and 17, 20 and 23, are included in the areas labeled FREE THROW on the board. The small red numbers appearing over the words FREE THROW apply.

Each time a new quarter begins, the zone control dials are set at one of the three start points. Whenever the ball changes hands, the defensive team immediately rotates the zone control dial clockwise to the next set of numbers. Any time the offensive team wishes to challenge a "Buzz" it may do so by requiring the defensive team to show the number on its zone control indicator.

From the foregoing it will be apparent that I have provided a game which, while affording a means of recreation, will further stimulate interest by the introduction of an element of strategic choice whereby any one of a number of situations may occur, as in an actual game of basketball. While I have illustrated and described a preferred embodiment of my game board and appurtenances, it should be understood that further modifications may be made within the spirit and intent of Title 35 United States Code, Section 112, Par. 3.

I claim:

1. A game board having a playing area divided into a plurality of longitudinally and transversely aligned rows of zones, a playing piece adapted to be advanced from zone to zone in a generally longitudinal direction, the center transverse row of zones being unidentified by numerals, zones on either side of said central row being individually identified by number; control means associated with said zone numbering system whereby a limited combination of said zone-identifying numbers can be set to permit a continuance of movement of said playing piece from zone to zone, along one or more of a number of paths, while blocking movement along others, all of said zones, except the centrally located starting zone, being marked with a series of probability numbers.

2. A game board as in claim 1 wherein said board is provided with quarter and score indicating means.

* * * * *